US007775841B2

(12) United States Patent
Coe et al.

(10) Patent No.: US 7,775,841 B2
(45) Date of Patent: Aug. 17, 2010

(54) HYPERBOLOID ELECTRICAL CONTACT

(75) Inventors: Thomas D. Coe, Boxford, MA (US); Paul M. Gurrisi, Kingston, NH (US); John Verity, Manchester, NH (US)

(73) Assignee: QA Technology Company, Inc., Hampton, NH (US)

( * ) Notice: Subject to any disclaimer, the term of this patent is extended or adjusted under 35 U.S.C. 154(b) by 154 days.

(21) Appl. No.: 12/194,094

(22) Filed: Aug. 19, 2008

(65) Prior Publication Data

US 2009/0061700 A1 Mar. 5, 2009

Related U.S. Application Data

(60) Provisional application No. 60/966,283, filed on Aug. 27, 2007.

(51) Int. Cl.
*H01R 13/187* (2006.01)

(52) U.S. Cl. ..... 439/843

(58) Field of Classification Search ..... 439/843–847
See application file for complete search history.

(56) References Cited

U.S. PATENT DOCUMENTS

| | | | | |
|---|---|---|---|---|
| 3,107,966 | A | | 10/1963 | Bonhomme |
| 3,229,356 | A | | 1/1966 | Bonhomme |
| 3,470,527 | A | | 9/1969 | Bonhomme |
| 5,036,583 | A | * | 8/1991 | Prochaska et al. ..... 29/882 |
| 5,588,852 | A | * | 12/1996 | Puerner ..... 439/135 |
| 5,897,404 | A | * | 4/1999 | Goodman et al. ..... 439/843 |
| 6,102,746 | A | | 8/2000 | Nania et al. |
| 6,767,260 | B2 | | 7/2004 | Lascelles et al. |
| 6,848,922 | B2 | | 2/2005 | Coughlan et al. |
| 7,191,518 | B2 | | 3/2007 | Beloritsky et al. |
| 2003/0162447 | A1 | | 8/2003 | Beloritsky et al. |

* cited by examiner

*Primary Examiner*—James Harvey
(74) *Attorney, Agent, or Firm*—Weingarten, Schurgin, Gagnebin & Lebovici LLP

(57) ABSTRACT

A hyperboloid contact socket includes a tubular body of metal or other suitable conductive material. The tubular body includes first and second ends. The first end includes a lip defining an aperture entrance for receiving a mating pin terminal. At the second end of the tubular body, a spline is crimped or otherwise affixed to the confronting end of the tubular body. The spline has an integral termination extending therefrom. The tubular body contains a plurality of conductive wires affixed at their respective ends to respective inner surfaces at or near the outer and inner ends of the body and disposed in an angular disposition to form the shape of a single sheet hyperboloid. Permanent and conductive attachment of the wires to the tubular body and the spline is provided through deformation of the body by rolling, crimping, swaging or other suitable means.

14 Claims, 4 Drawing Sheets

HYPERBOLOID ELECTRICAL CONTACT

CROSS REFERENCE TO RELATED APPLICATIONS

This application claims priority benefit of U.S. provisional patent application No. 60/966,283 filed Aug. 27, 2007 and is related to U.S. Pat. Nos. 6,767,260 and 7,191,518, which are both assigned to the assignee of the present application.

STATEMENT REGARDING FEDERALLY SPONSORED RESEARCH OR DEVELOPMENT

Not Applicable

BACKGROUND OF THE INVENTION

Hyperboloid electrical contacts or contact sockets are known for their reliability, resistance to vibration, low insertion force, low electrical resistance and high number of insertion/extraction cycles. A conventional hyperboloid contact socket is depicted in FIG. 1 and includes an inner tubular sleeve which is open at both ends and which is located coaxially within two cylindrical sections that form an outer shell. The distal end of one of the outer sections is machined to form a cavity for permanently affixing wires to the contact either by soldering or crimping. Alternatively the distal end can be machined to form a pin to be soldered or press fit into a circuit board, or used to affix wires by wrapping them onto the pin. The proximal end of the second outer cylindrical section remains open to receive the male pin of a mating connector or device. A plurality of loose, or floating wires is arrayed within the inner sleeve to form the shape of a single sheet hyperboloid. At each end of the inner sleeve the wires are bent 180 degrees outward so as to return axially between the inner and outer sleeves. The wire ends are thereby retained at each end of the inner sleeve by means of a press fit between the wires and the inner and outer sleeves as shown in the prior art FIG. 1. Rolling, crimping, swaging or other suitable means to provide mechanical and conductive attachment is used to affix the outer sleeves at or near the axial midpoint of the inner sleeve. This contact configuration has been in use for many years and is known to present a difficult assembly task and to require expensive, high precision machined components. Additionally, due to the nature of the press fit retention of the wires, it is not uncommon for the wires to become separated from within the inner and outer sleeves, particularly during usage of the contact, thereby leading to field failures of the device in which it is in use. Additionally, this type of field failure can lead to damage of the mating male connector elements, further exacerbating the extent and cost of repair of the overall system in which the contact has been deployed. In addition, because of the concentric arrangement of the inner and outer cylindrical sections and the retained contact wires, the contact structure is larger in diameter than other forms of contacts and cannot therefore be used in applications requiring higher contact density, or in applications requiring the characteristics set forth above where miniaturization must be realized. Examples of the foregoing prior art are shown in U.S. Pat. Nos. 3,107,966, 3,229,356, 3,470,527 and 6,102,746.

More recently hyperboloid contact sockets have been developed which can be manufactured using automated high speed manufacturing processes wherein different types of terminations can be affixed to the contact socket as desirable for user requirements. This type of hyperboloid contact socket is depicted in FIG. 2 and is described in U.S. Pat. No. 6,767,260 which is owned by the assignee of the present application. The socket includes a tubular body 20, one end of which has a lip 22 defining an entrance aperture 24 for receiving a mating pin. The tubular body 20 contains a plurality of conductive wires 28 welded or otherwise conductively and permanently affixed at their respective ends to the inner surface of the tubular body at respective ends of the body and disposed in an angular disposition with respect to the longitudinal axis to form a hyperboloid shape. The tubular body 20 is attached to a termination 26 at a junction 27 by rolling, crimping, swaging or other suitable means to provide mechanical and conductive attachment.

The socket is formed via use of a mandrel having a plurality of spaced longitudinal wire receiving grooves. Wires are inserted within the grooves of the mandrel and the wires are inserted into the tubular body to the point at which the wires abut the inner annular surface of the lip. The upper ends of the wires are permanently affixed, preferably by laser welding or other suitable means, to the confronting inner wall portion of the tubular body adjacent the lip.

The mandrel is then partially withdrawn and rotated with respect to the body by a predetermined angular extent to produce an angular orientation of the wires and the lower end of the wires are conductively and permanently affixed to the confronting wall portion of the tubular body, preferably by laser welding, or other suitable means, and the body and the mandrel are thereafter separated. The resultant body has the wires angularly disposed within the body so as to form a hyperboloid shape which accommodates and provides electrical engagement with a terminal pin that is inserted into the contact socket through the aperture 24. This type of hyperboloid contact socket offers the advantages of a smaller diameter, reduction in the number of machined components and suitability for automated high speed manufacture when compared to earlier hyperboloid contacts.

In one embodiment disclosed in U.S. Pat. No. 6,767,260, one end of the mandrel is affixed to the body and a termination is affixed to the other end of the mandrel as illustrated in FIG. 3. One problem for this type of hyperboloid socket contact is that the overall length of the contact is increased due to the presence of the mandrel in the assembled socket. This makes the contact unsuitable for high density applications requiring a short contact, such as would be the case in printed circuit board connectors or in connectors where axial space is limited. In addition, this type of contact could be reduced in diameter still further, allowing for greater contact density, if it were not necessary to provide for terminations to be attached to the outside diameter of the mandrel as shown in FIG. 3. Examples of the foregoing prior art are shown in U.S. Pat. Nos. 6,767,260 and 7,191,518 which are assigned to the assignee of the present application.

It would be useful to provide a hyperboloid contact socket having a shorter overall length to permit its use in printed circuit board connector applications. It would also be useful to provide a hyperboloid contact socket having a smaller outside diameter to permit use in applications requiring closer center distance spacing. It would also be useful to reduce the cost of manufacturing through the elimination of unnecessary parts and through improvement in the efficiency of assembly by permanent and conductive attachment of the contact wires into position within a contact body to form the hyperboloid contact area. It would also be useful to provide a contact socket where the need for costly machined components is reduced or eliminated.

BRIEF SUMMARY OF THE INVENTION

In accordance with the present invention, a hyperboloid contact socket is provided that includes a tubular body of metal or other suitable conductive material having first and second ends. The first end includes a U shaped lip defining an annular cavity at a first end of the body and providing an aperture entrance for receiving a mating pin terminal. The tubular body contains a plurality of conductive wires affixed at their respective ends to respective inner surfaces at or near the first and second ends of the body and disposed in an angular orientation with respect to a longitudinal axis of the socket to form the shape of a single sheet hyperboloid. Permanent and conductive attachment of the wires to the tubular body is provided through deformation of the body by rolling, crimping, swaging or other suitable means. More specifically, at the first end of the body, the wires are disposed within the annular cavity formed by the U shaped lip and affixed to the body by rolling, crimping or swaging the body to permanently capture the wires within the annular cavity formed by the body and the portion of the lip extending into the opening within the body.

The wires are disposed in longitudinal grooves provided in a spline having an integral termination extending therefrom. The form of the termination may vary based on the intended application. The spline is inserted into the second end of the tubular body with the wires disposed in respective longitudinal grooves of the spline and the spline is rotated within the tubular body to form a hyperboloid contact within the body. The second end of the tubular body is deformed by rolling, crimping, swaging or other suitable means to permanently capture and secure the wires in conductive relation between the inner surface of the tubular body and the spline.

Other features, aspects and advantages of the presently disclosed hyperboloid socket will be apparent to those of ordinary skill in the art from the Detailed Description of the Invention which follows.

BRIEF DESCRIPTION OF THE SEVERAL VIEWS OF THE DRAWINGS

The present invention will be more fully understood by reference to the following Detailed Description of the Invention in conjunction with the drawings of which.

DETAILED DESCRIPTION OF THE INVENTION

Figure 1:
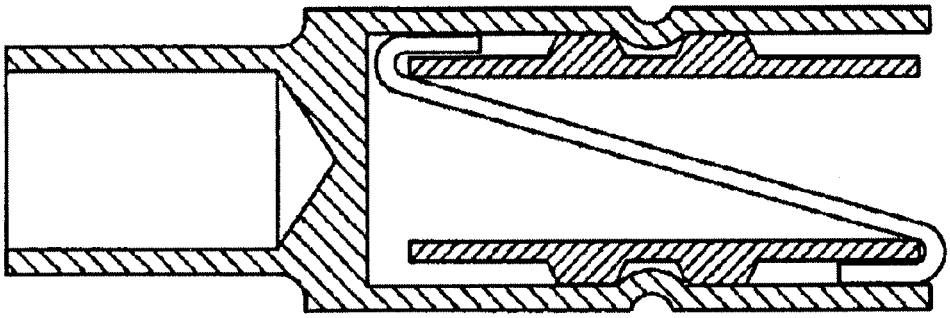
Fig. 1 Prior Art
FIG. 1 is a cross-sectional side view of a prior art hyperboloid contact having inner and outer sleeves.
Figure 2:
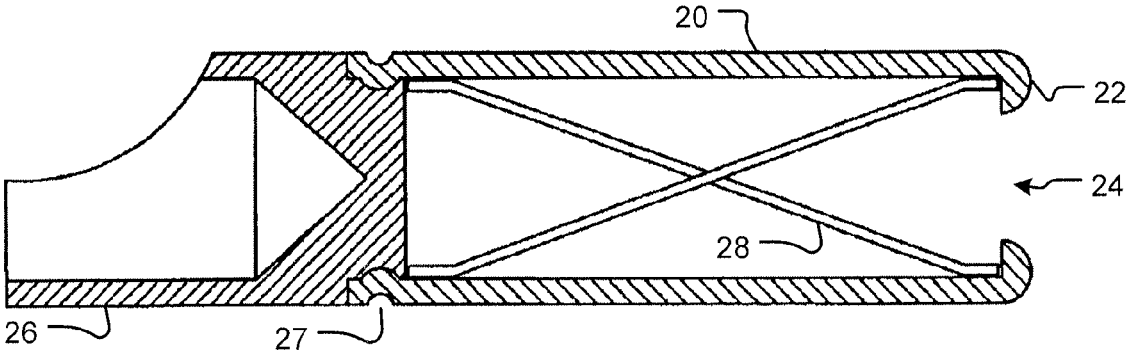
Fig. 2 Prior Art
FIG. 2 is a prior art hyperboloid contact having wires affixed to inner surfaces at first and second ends of the tubular body.
Figure 3:
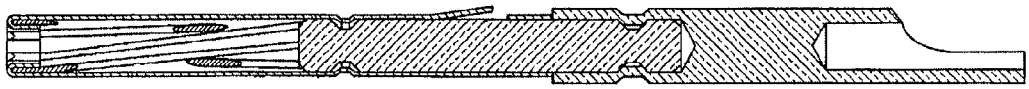
Fig. 3 Prior Art
FIG. 3 is a cross-sectional side view of a prior art hyperboloid contact that includes a mandrel disposed between and in conductive communication with a tubular socket body and a termination member.
Figure 4A:
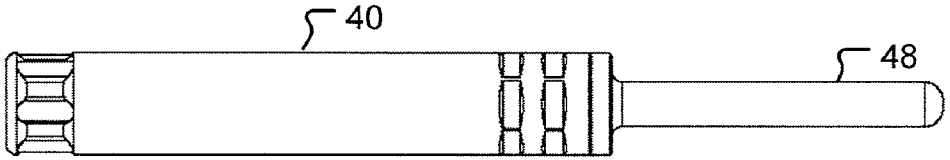
FIG. 4*a* is a side view of a hyperboloid contact in accordance with the present invention.
Figure 4B:
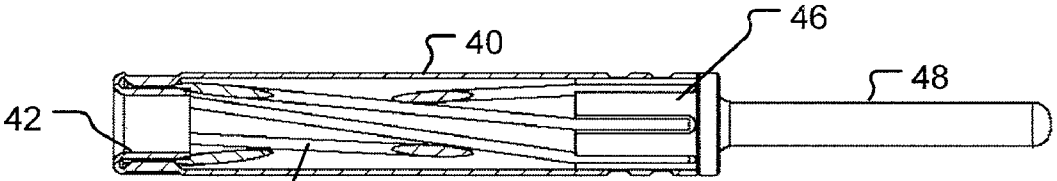
FIG. 4*b* is a partial cut-away side view of the hyperboloid contact of FIG. 4*a;*
Figure 4D:
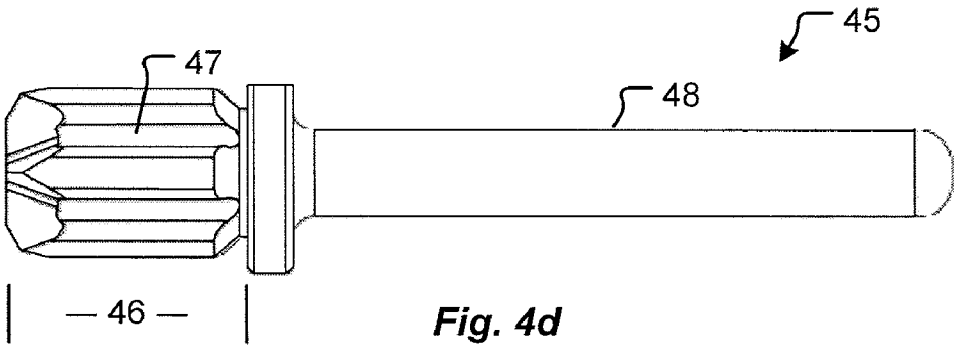
FIG. 4*d* is a side view of the spline that is disposed within the tubular body of FIG. 4*a;*
Figure 4C:
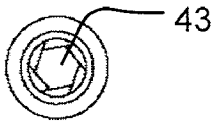
FIG. 4*c* is an end view of the hyperboloid contact of FIGS. 4*a* and 4*b* viewed from the pin-receiving end of the hyperboloid contact.

The disclosures of U.S. provisional application 60/966,283 filed Aug. 27, 2007 and U.S. Pat. Nos. 6,767,260 and 7,191,518 are hereby incorporated by reference.

A hyperboloid contact socket is provided which can be manufactured in a cost efficient manner using automated high speed manufacturing processes and equipment. Different types of terminations can be affixed to the contact socket as desirable to suit user requirements.

Referring to FIGS. 4*a*-4*d*, the contact socket includes a tubular body 40 which is fabricated of metal or any other suitable conductive material. The tubular body 40 preferably includes at one end a lip 42 defining an entrance aperture 43 for receiving a mating pin terminal (not shown). On the opposite end of the tubular body, a termination member 45 includes a spline 46 that is crimped or otherwise affixed to the confronting inner surface of the tubular body 40. The termination member 45 includes the spline 46 and additionally, a termination 48 for mechanically and conductively coupling the contact to a printed circuit board, wire or any other electrical contact terminal for the purpose of making an electrical connection between that termination and a conductive member. The termination 48 is formed integrally with the spline 46 as a single unitary piece. The tubular body 40 contains a plurality of conductive wires 41 affixed at their respective ends to respective inner surfaces at or near the ends of the tubular body and disposed with an angular orientation with respect to a longitudinal axis of the tubular body 40 to form the shape of a single sheet hyperboloid. More specifically, the tubular body 40 has a first or outer end having a lip 42 that forms a pin receiving aperture for the hyperboloid contact. The lip is U shaped and extends into the tubular body 40 so as to form a U shaped annular cavity between the lip and the inner surface of the tubular body 40. The annular cavity is opens toward the second end of the tubular body 40.

The tubular body 40 includes a second or inner end on the distal end of the tubular body 40 from the first end for receiving the spline 46. The spline 46 includes a plurality of wire receiving longitudinal grooves 47 that receive one end of the conductive wires that form the hyperboloid shaped pin receiving contact as subsequently described.

The spline 46 that is intended for insertion within the tubular body 40 has a diameter corresponding generally to the inner diameter of the tubular body 40. The spline 46 may thus be inserted into the second end of the tubular body 40 such that the outer diameter of the inserted spline portion confronts the inner surface of the tubular body 40 when it is disposed within the second end of the tubular body 40.

The socket is assembled by aligning wires within the cavity formed by the lip 42 and deforming the lip by rolling, crimping or swaging the first end of the tubular body 40 to permanently capture and secure the wires 41 within the first end of the body 40. The wires 41 are disposed in longitudinal grooves 47 of the spline 46 while the spline is inserted within the second end of the tubular body 40. Following insertion of the spline 46 into the second end of the body 40, the spline 46 is rotated with respect to the body 40 to dispose the wires 41 in an angular orientation with respect to the longitudinal axis of the tubular body 40 to form a hyperboloid shape which serves as a pin receiving opening for a cooperative pin terminal.

After insertion of the spline 46 within the second end of the tubular body 40, the second end of the tubular body 40 is deformed by rolling, crimping or swaging in the area of the spline 46 to securely and permanently capture the wires 41 between the tubular body 40 and the spline 46 and to permanently mechanically and conductively affix the spline to the tubular body 40.

Thus, the assembled hyperboloid contact is fabricated from two pieces, namely, the tubular body 40 and the termination member 45 in addition to the wires 41 that form the hyperboloid contact.

The body is preferably manufactured by deep drawing which is less expensive than precision machine parts usually required by conventional designs.

Figure 5A:
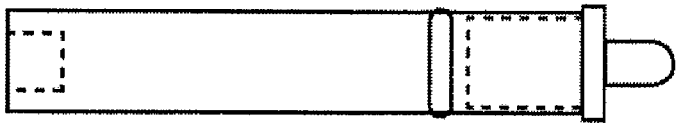
FIG. 5*a* is a side view of an embodiment of a hyperboloid contact in accordance with the present invention having a surface mount terminal as a termination.
Figure 5B:
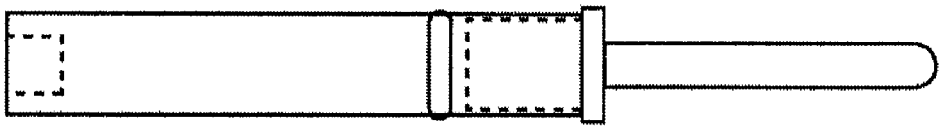
FIG. 5*b* is a side view of an embodiment of a hyperboloid contact in accordance with the present invention having a first type of pin terminal as a termination.
Figure 5C:
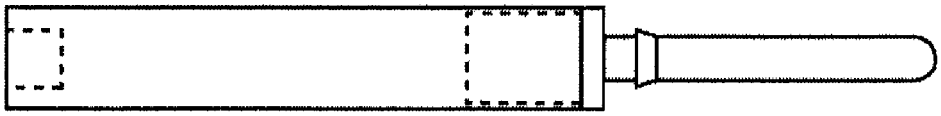
FIG. 5*c* is a side view of an embodiment of a hyperboloid contact in accordance with the present invention having a second type of pin terminal as a termination.
Figure 5D:
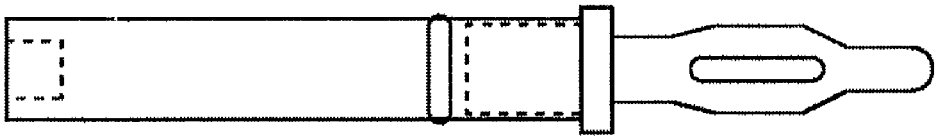
FIG. 5*d* is a side view of an embodiment of a hyperboloid contact in accordance with the present invention in accordance with the present invention having a compliant pin terminal as a termination.
Figure 5E:
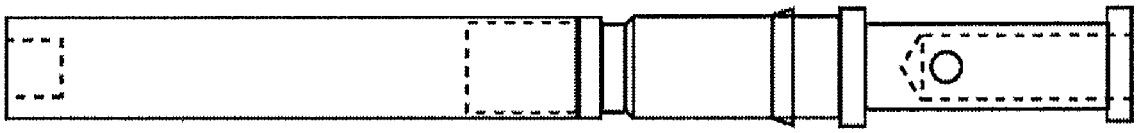
FIG. 5*e* is a side view of an embodiment of a hyperboloid contact in accordance with the present invention in accordance with the present invention having a first type of crimp barrel terminal as a termination.
Figure 5F:
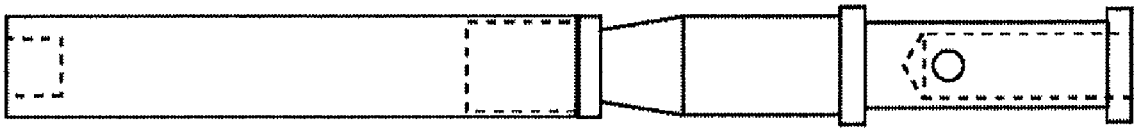
FIG. 5*f* is a side view of an embodiment of a removable hyperboloid contact in accordance with the present invention having a second type of crimp barrel terminal as a termination and where a retention clip would be located in the insulator to retain the contact.
Figure 5G:
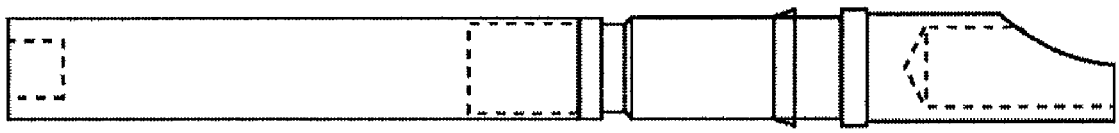
FIG. 5*g* is a side view of an embodiment of a hyperboloid contact in accordance with the present invention having a solder cup terminal as a termination.

The termination 48 can be of any type suitable to a user's requirements. By way of example, the termination 48 may be a surface mount terminal as illustrated in FIG. 5*a*, a pin terminal as illustrated in FIGS. 5*b* and 5*c*, a compliant pin terminal as illustrated in FIG. 5*d*, a crimp barrel terminal as illustrated in FIGS. 5*e* and 5*f* or a solder cup terminal as depicted in FIG. 5*g*. In addition to the specific terminations shown, it should the realized that any other suitable termination formed integrally with the spline 46 may be employed.

Figure 6:
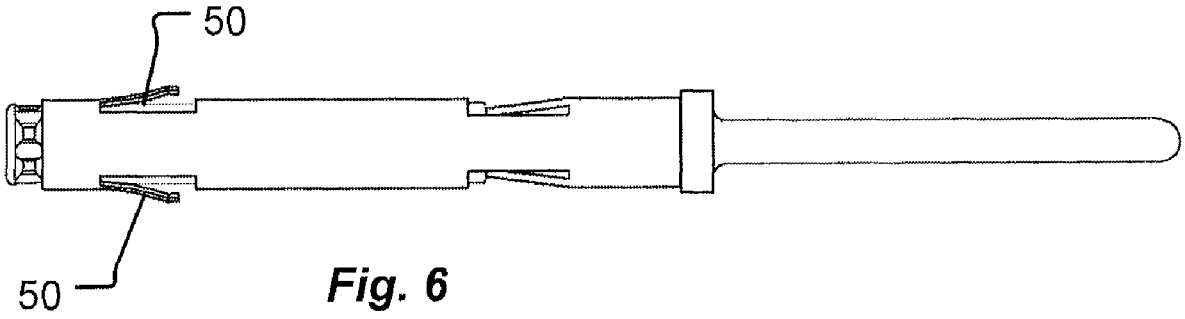
FIG. 6 is a side view of an embodiment of a removable hyperboloid contact in accordance with the present invention that includes retention clips formed in the tubular body for retaining the contact within a housing.

As depicted in FIG. 6, a retention ring or clip can be disposed on the tubular body, the clip having one or more outwardly angled wings or tabs 50 which can orient and lock the contact socket into an associated housing.

The disclosed contact socket is substantially shorter in length than the constructions available in the prior art having a mandrel which orients the wires within the tubular body and which remains attached to serve as a connecting pin to various terminations. In a typical embodiment, the present contact socket can be about 65% shorter than the previous type such as that shown in the '260 patent. In addition, the integration of the spline with the termination allows a smaller overall diameter which can be about the same size as that of the tubular section.

It will be appreciated that variations of and modifications to the above-described hyperboloid socket may be made without departing from the inventive concepts described herein. Accordingly, the invention should not be viewed as limited except by the scope and spirit of the appended claims.

What is claimed is:

1. A hyperboloid contact socket having a first end and a second end, said hyperboloid socket comprising:

a tubular body formed of a conductive material, said tubular body having first and second ends and a longitudinal axis, said tubular body having an inner surface, said body including a U shaped lip at the first end of the contact socket, said U shaped lip extending into the first end of the tubular body, said lip and said inner surface of said body forming an annular cavity in said first end that opens toward said second end of said tubular body;

a plurality of wires having first and second ends, said first ends of said wires being disposed within said annular cavity at said first end of said tubular body;

said first end of said tubular body being deformed to compress said inner body surface against said lip so as to permanently capture said wires between said inner surface and said lip;

a termination member formed of a conductive material, said termination member including a spline having a longitudinally grooved outer surface and a termination portion integrally formed with the spline as a one piece member and configured for attachment to a mating electrical member, said spline disposed within said second end of said tubular body with said outer surface of said spline in confronting relation with said inner surface of said second end of said tubular body, said tubular body being permanently affixed in conductive relation to said spline, said termination portion terminating at the second end of the contact socket;

said plurality of wires disposed in angular relation with respect to said longitudinal axis within said tubular body, said second ends of said wires being permanently affixed at the second ends of the tubular body within said longitudinal grooves of said spline and configured to form a hyperboloid socket within the tubular body.

2. A hyperboloid contact socket having a first end and a second end, said hyperboloid socket comprising:

a tubular body formed of a conductive material, said tubular body having first and second ends and a longitudinal axis, said tubular body having an inner surface, said first end of said tubular body corresponding to said first end of said hyperboloid contact socket;

a plurality of wires having first and second ends, said first ends of said wires being disposed in permanent conductive contact with said inner surface of said tubular body at said first end of said tubular body;

a termination member formed of a conductive material, said termination member including a spline having an outer surface and a termination portion integrally formed with the spline as a one piece member and configured for attachment to a mating electrical member, said spline disposed within said second end of said tubular body with said second ends of said plurality of wires disposed in conductive relation between said outer surface of said spline and said inner surface of said second end of said tubular body, said second end of said tubular body being deformed in compressive relation with respect to said second ends of said wires and said outer surface of said spline to permanently secure said second ends of said wires between said inner surface of said second end of said tubular body and said spline, said termination portion terminating at the second end of said hyperboloid contact socket;

said plurality of wires disposed in angular relation with respect to said longitudinal axis within said tubular body to form a hyperboloid socket within the tubular body with a pin receiving aperture at said first end of said body.

3. The hyperboloid contact of claim 1 wherein said second end of said tubular body is deformed around said spline to permanently affix said spline to said tubular body and securely capture said plurality of wires between said spline and said inner surface of said tubular body.

4. The hyperboloid contact of claim 1 wherein the termination portion is a surface mount terminal.

5. The hyperboloid contact of claim 1 wherein the termination portion is a pin terminal.

6. The hyperboloid contact of claim 1 wherein the termination portion is a compliant pin terminal.

7. The hyperboloid contact of claim 1 wherein the termination portion is a crimp barrel terminal.

8. The hyperboloid contact of claim 1 wherein the termination portion is a solder cup terminal.

9. The hyperboloid contact of claim 2 wherein the termination portion is a solder cup terminal.

10. The hyperboloid contact of claim 2 wherein said spline includes spaced longitudinal grooves along the outer surface and said second ends of said wires are disposed in respective longitudinal grooves.

11. The hyperboloid contact of claim 2 wherein the termination portion is a surface mount terminal.

12. The hyperboloid contact of claim 2 wherein the termination portion is a pin terminal.

13. The hyperboloid contact of claim 2 wherein the termination portion is a compliant pin terminal.

14. The hyperboloid contact of claim 2 wherein the termination portion is a crimp barrel terminal.

* * * * *